US008485113B2

(12) United States Patent
Hannon

(10) Patent No.: US 8,485,113 B2
(45) Date of Patent: Jul. 16, 2013

(54) UNIVERSAL SECURITY PLATE FOR AUTOMATIC TELLER MACHINES

(75) Inventor: Kenneth C. Hannon, Anaheim Hills, CA (US)

(73) Assignee: PSSI International, Inc., Glendale, CA (US)

( * ) Notice: Subject to any disclaimer, the term of this patent is extended or adjusted under 35 U.S.C. 154(b) by 0 days.

(21) Appl. No.: 13/172,493

(22) Filed: Jun. 29, 2011

(65) Prior Publication Data

US 2013/0000227 A1 Jan. 3, 2013

(51) Int. Cl.
*E05G 1/00* (2006.01)

(52) U.S. Cl.
USPC ..... 109/50; 52/294; 109/52

(58) Field of Classification Search
USPC ..... 52/833, 294, 295, 659, 173.1, 27.5, 52/298; 109/58, 78, 85, 24.1, 50–52; 235/379, 235/381; 248/551, 678, 346.01, 519, 534, 248/535, 539, 637, 679, 680; D99/28, 33
See application file for complete search history.

(56) References Cited

U.S. PATENT DOCUMENTS 3,190,041 A * 6/1965 Kimball ..... 248/679
3,311,333 A * 3/1967 Galloway ..... 52/295
3,758,058 A * 9/1973 Neudeck et al. ..... 410/46
4,162,596 A * 7/1979 Damman ..... 52/295
4,399,755 A * 8/1983 Wiedmann ..... 109/2
4,505,449 A * 3/1985 Turner et al. ..... 248/669
4,893,777 A * 1/1990 Gassaway ..... 248/551
5,553,552 A * 9/1996 Bauer et al. ..... 109/24.1
6,061,971 A * 5/2000 Wolters et al. ..... 52/27.5
6,896,181 B2 * 5/2005 Utz ..... 235/379
7,036,719 B1 * 5/2006 Helphrey et al. ..... 232/47
7,427,054 B2 * 9/2008 Sommerville et al. ..... 248/551
2002/0026754 A1 * 3/2002 Acketts et al. ..... 52/27.5
2005/0121593 A1 * 6/2005 Acketts ..... 248/650
2006/0056921 A1 * 3/2006 Simmons ..... 405/203
2009/0314921 A1 * 12/2009 Gould ..... 248/636
2010/0170424 A1 * 7/2010 Pinho ..... 109/50

* cited by examiner

*Primary Examiner* — Robert Canfield
*Assistant Examiner* — Babajide Demuren
(74) *Attorney, Agent, or Firm* — Blakely Sokoloff Taylor & Zafman, LLP

(57) ABSTRACT

A system and method to secure a free-standing automatic teller machine (ATM). An attachment plate having a plurality of sleeves that align with attachment point on an ATM is embedded in a concrete platform before the concrete is cured. The ATM is positioned on the surface of the attachment plate so that its attachment points aligned with a subset of sleeves. The ATM is then bolted into the sleeves. When so installed it is nearly impossible to dislodge the ATM from the platform with typical mechanical equipment such as trucks, tractors etc.

13 Claims, 3 Drawing Sheets

UNIVERSAL SECURITY PLATE FOR AUTOMATIC TELLER MACHINES

BACKGROUND

1. Field of the Invention

Embodiments of the invention relate to automatic teller machines and installation thereof. More specifically, embodiments of the invention relate to a system and installation method to reduce the risk of ATM theft.

2. Background

Automatic teller machines (ATM) are ubiquitous in today's commercial environment. While some ATMs exist within structures, such as shopping malls and supermarkets, ATMs are also commonly installed as free-standing units in parking lots and other outdoor areas. These free-standing units are sometimes referred to as "island" ATMs because they are often installed in an island for drive-up use, for example.

Currently ATMs are manufactured by a number of manufacturers including NCR, Diebold and others. Each ATM typically has a plurality of attachment points defined by that vendor. Different vendors have different patterns of attachment points. Banks purchase ATMs from these vendors and deploy them as part of their network of ATMs. But between deployments, any particular bank may switch venders or may buy from more than one vender in different concurrent orders.

When an island ATM is to be installed, first, the island is built typically of concrete and cured until it is solid. Often the island is equipped with a number of bollards to protect the ATM from accidental or intentional damage. Thereafter, the ATM is put in place on the island. Holes are drilled from inside the ATM into the concrete consistent with the attachment points defined by the ATM. This drilling often results in dust and particulates potentially contaminating the internals of the ATM. Once the holes are drilled, red head anchors are sunk into the concrete to hold the machine in place.

Unfortunately, this system fails to provide sufficient security for the ATM. Thefts of entire ATM machines have become increasingly common. One common tactic is to dislodge the machine from its platform using e.g. a truck with a log chain, a tractor, or other such vehicle. The thieves then make off with the entire ATM machine to break it open at a more secure location. These incidents cost the ATM owner hundreds of thousands of dollars per incident. It therefore would be desirable to mitigate the risk of ATM theft and improve the security of free-standing ATMs.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
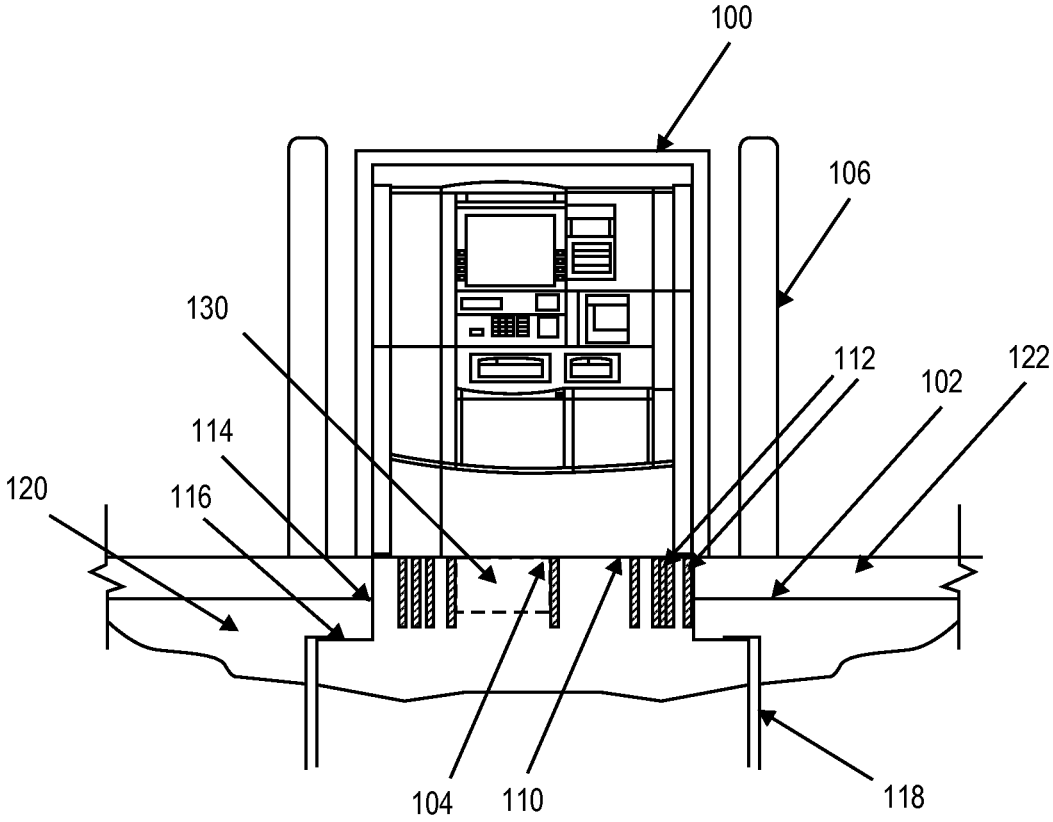
FIG. 1 is a schematic diagram of the system of one embodiment of the invention.

FIG. 1 is a schematic diagram of the system of one embodiment of the invention. An ATM 100 is installed on an attachment plate 104 embedded within a platform 102. A number of bollards 106 may also be installed in platform 102 to protect the ATM 100 from unintentional damage. Attachment plate 104 has an attachment surface 110 that is exposed through an upper surface of platform 102. Platform 102 includes a curb 122 which rises above the ground level and underlying concrete 120 that forms a base for the curb 122.

Attachment plate 104 includes a pair of side panels 114 coupled to the attachment surface 110. In one embodiment, this coupling is at a generally right angle. The distal end of side panels 114 couples to retention panels 116. As can be seen in FIG. 1, side panels 114 effectively vertically displace retention panels 116 relative to attachment surface 110. In some embodiments, this displacement is selected to be greater than the height of curb 122. Typically, the curb 122 will be eight inches in height. Thus, side panels 114 will generally provide a vertical displacement in excess of nine inches and, in one embodiment, twelve inches has been found to be a desirable vertical displacement.

Generally, platform 102 will be formed from rebar reinforced concrete. In some embodiments, attachment plate 104 includes rebar tie-ins to tie into the rebar reinforcement in the concrete. Additionally, because the retention panels 116 are embedded beneath a significant volume of concrete, the attachment plate is generally resistant to being pulled from the ground. As an additional measure, in some embodiments, steel set rod bolts 118 may be driven deeper into the concrete 120 and engage retention panels 116 to increase the stability of the attachment plate within platform 102. In one embodiment, rod bolts 118 are eighteen inches long.

Attachment plate 104 also includes a plurality of sleeves 112 coupled below attachment surface 110. The plurality of sleeves are arranged to align with attachment points defined by ATM 100. In some embodiments, only sleeves to accommodate a particular manufacturer's ATM may be provided. In alternative embodiments, sleeves are provided for configurations of all or a subset of existing commercially available ATMs such that for any installation only a portion of the sleeves will actually be used. In one embodiment, all the sleeves are dimensionally the same. In one embodiment, the sleeves are threaded to receive attachment bolts. Typically, the sleeves are greater than eight inches in length. In one embodiment the sleeves are nine inches long. It is generally desired that the sleeves be greater than ½ inch in diameter and sleeves to receive ¾ inch grade 8 or grade 9 bolts are used in one embodiment of the invention. In one embodiment, ¾ inch grade 8 bolts 6" long have been found satisfactory. Such bolts resist up to 250,000 pounds of pressure before shearing. In one embodiment the sleeves are nine inches long.

Finally, attachment plate 104 includes a pull box defining a chamber 130 to retain power and ground connections for the ATM 100. Chamber 130 is watertight to prevent damage to the electrical equipment contained therein. In one embodiment, attachment plate 104 is fabricated in, for example, a machine shop and shipped to the installation location. In one embodiment, a ½ inch steel plate is bent to form attachment surface 110, side panels 114 and retention panels 116. Alternatively, the different panels may be joined by welding. In both cases the panels are deem "coupled" together as the term is used herein. The entire plate 104 may be powder coated to prevent corrosion. In one embodiment, the chamber 130 is formed from ⅛" steal panels welded to a ½ plate.

Cylindrical sleeves are then welded to the underside of attachment surface 110. The sleeves may be drilled and tapped to thread them for the receipt of appropriate bolts. The arrangement of sleeves on the underside is selected to be consistent with the attachment points defined by existing commercially available ATMs. The pull box defining chamber 130 may also be welded to the underside of attachment surface 104 in a location not occupied by the sleeves 112.

Figure 2:
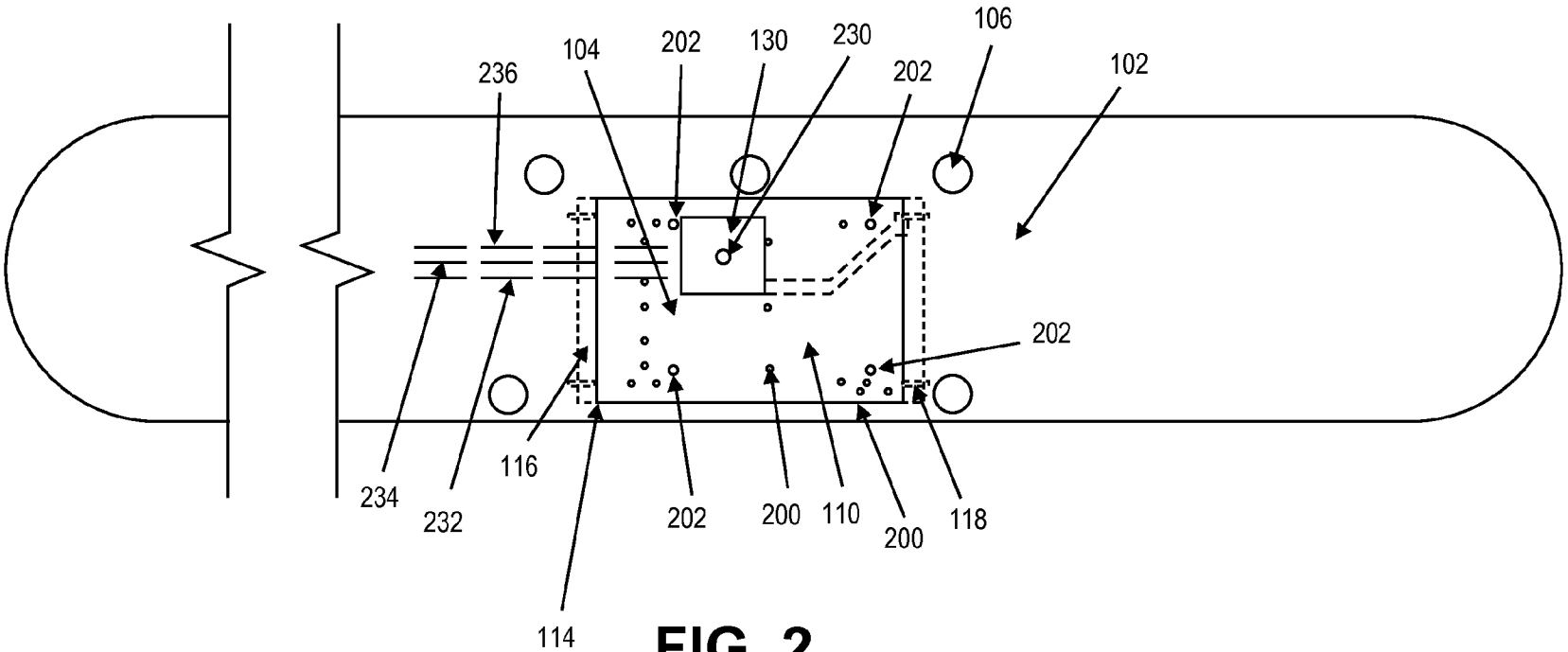
FIG. 2 is a schematic diagram of an overhead view of one embodiment of the invention prior to ATM installation.

FIG. 2 is a schematic diagram of an overhead view of one embodiment of the invention prior to ATM installation. Attachment surface 110 is exposed through platform 102. Retention panels 116 are vertically displaced by side panels 114 from attachment surface 104 and embedded within platform 102. Steel rod bolts 118 further engage retention panels 116 to hold the plate within the platform. Sleeve openings 202, which correspond to a Diebold ATM, are shown as one representation. Other sleeve openings 200, which correspond to other ATM vender attachment point schemes, are shown as a different representation in this figure. However, this is merely for illustration as in most embodiments the opening 200, 202 will be dimensionally identical. In this example, 21 sleeve openings in total are shown. Different embodiments may have more or fewer sleeves depending on the number of ATM models to be accommodated by the particular embodiments.

In some embodiments, a pressure sensitive alarm switch 230 may be exposed on the attachment surface. The switch 230 will trigger a security alert or alarm responsive to pressure changes such as the removal or attempted removal of the ATM once the alarm is armed. Also represented schematically is a conduit 232 for power, a conduit 234 for data and a conduit 236 for the security system are shown running to chamber 130. In one embodiment, the power conduit 232 is 2" in diameter and the other two conduits 234, 236 are 1" in diameter.

Once attachment plate 104 is embedded in platform 102, the installation of an ATM thereon is relatively simple. By way of example, installing a Diebold ATM on attachment plate, one would align the attachment points of the Diebold machine with the sleeve openings 202 and drive four bolts, one into each sleeve to secure the machine 100 to the plate 104. Thereafter, it is a matter of connecting power, data and security. Optionally, the ATM may also be welded to expose metal of the attachment surface 110.

Figure 3:
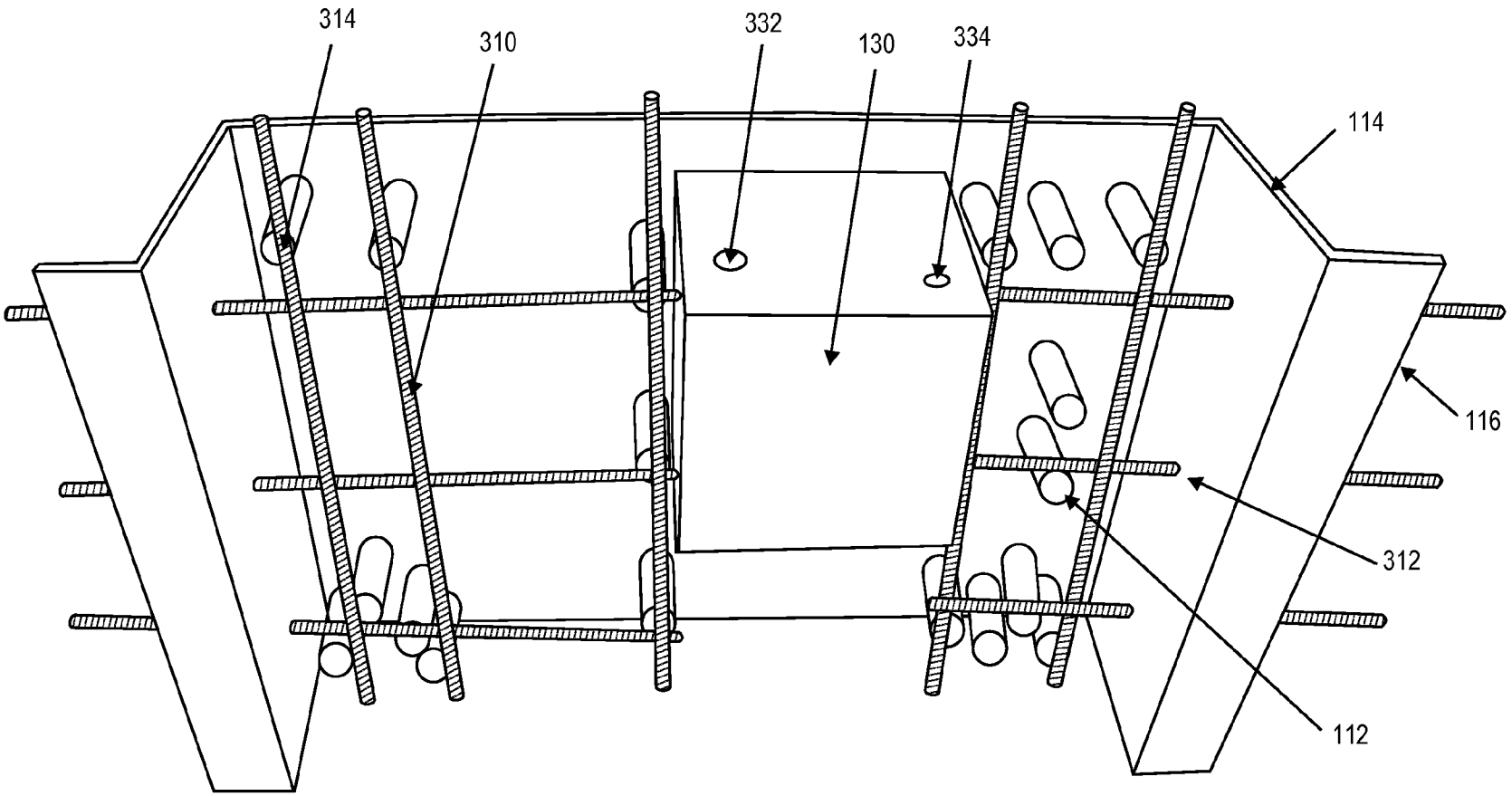
FIG. 3 is a schematic diagram of a bottom view of an attachment plate of one embodiment of the invention.

FIG. 3 is a schematic diagram of a bottom view of an attachment plate of one embodiment of the invention. The box defining chamber 130 defines an opening 332 for attachment of a power conduit and opening 334 for attachment of a data conduit. Internally, the chamber may be divided to separate the power and data components such that noise on the power line does not interfere with data interchange.

In one embodiment, side panels 114 define rebar tie-ins 312, such as through perforations in the side panel 114 such that rebar 310 can pass there through in its integration with the concrete. Additionally, the rebar 310 may be tied 314 in to one or more of the sleeves 112, such as by welding thereto. Alternatively, in some embodiments, the sleeves may be manufactured to include an eyelet to receive the rebar. By tying into the rebar embedded within the concrete, the attachment plate is further secured therein.

Generally, for a particular site, the platform is formed and the attachment plate embedded prior to cure of the concrete. Then the ATM may be bolted and optionally welded thereto. Should it become desirable to switch out the ATM, no reinstallation of the plate is required. The old ATM is merely unbolted, and the new one aligned and bolted in place. In some embodiments, the plate can be retrofitted for anew ATM configuration. In Such embodiment, a 2"×2" square is cure in the installed plate at the location of the attachment points. Then after coring the concrete with a 3" drill bit a new threaded shaft is inserted and welded in place. The shaft may then be back filled with epoxy to complete the retrofit. Once installed as described it has been found that dislodging the ATM is nearly impossible using the tactic that have been employ in the rash of ATM thefts in recent years.

In the foregoing specification, the invention has been described with reference to the specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

an automatic teller machine (ATM) defining a plurality of attachment points;

a concrete platform; and a metal attachment plate embedded into the concrete platform, the plate having a plurality of sleeves, with each attachment point of the ATM having a corresponding sleeve aligned therewith, the attachment plate including an attachment surface exposed above the concrete;

the sleeves below the attachment surface;

an electronics chamber defined below the attachment surface;

a pair of side panels coupled to the attachment surface; and a pair of oppositely disposed retention panels coupled to the side panels retained beneath the surface of the concrete and vertically displaced relative to the attachment surface.

2. The apparatus of claim 1, wherein the sleeves can accommodate one of grade 8 or grade 9 bolts.

3. The apparatus of claim 1, further comprising:

a plurality of bolts engaging the retention panels and extending deeper into the concrete.

4. The apparatus of claim 1, wherein the vertical displacement is greater than 9 inches.

5. The apparatus of claim 1, wherein the electronics chamber is divided into a power chamber and a data chamber.

6. The apparatus of claim 1, wherein the attachment plate comprises half-inch thick steel.

7. The apparatus of claim 1, wherein each sleeve comprises:

internal threading.

8. The apparatus of claim 7, wherein each sleeve is greater than one half-inch in diameter and greater than eight inches in length.

9. The apparatus of claim 1, wherein the concrete platform is rebar reinforced and the attachment plate comprises a plurality of rebar tie ins and further wherein the attachment plate is tied into the rebar reinforcement.

10. A method of using a metal attachment plate having an attachment surface coupled two side panels that vertically displace two retention panels from the attachment surface comprising:

forming a platform of concrete;

embedding the metal attachment plate in the concrete platform during the forming including disposing the attachment plate within the concrete prior to curing of the concrete such that the attachment surface is substantially flush with the upper surface of the concrete platform; and attaching an automatic teller machine (ATM) to the attachment plate at least in part by bolting the ATM into a subset of a plurality of threaded sleeves.

11. The method of claim 10, wherein attaching further comprises:

welding the ATM to an attachment surface of the attachment plate.

12. The method of claim 10, wherein embedding comprises:

tying the attachment plate into rebar reinforcement within the concrete platform.

13. The method of claim 10, wherein embedding further comprises bolting the retention panel deeper into the concrete.

* * * * *